US005829508A

United States Patent [19]

DeBower et al.

[11] Patent Number: 5,829,508

[45] Date of Patent: Nov. 3, 1998

[54] DOOR CLOSER AND METHOD

[75] Inventors: Marc M. DeBower, Des Moines, Iowa; Walter B. Herbst, Lake Forest, Ill.; James E. Schooler, Ackworth; Gordon D. Hansen, Des Moines, both of Iowa

[73] Assignee: EMCO Enterprises, Inc., Des Moines, Iowa

[21] Appl. No.: 599,293

[22] Filed: Feb. 9, 1996

Related U.S. Application Data

[63] Continuation-in-part of Ser. No. 582,290, Jan. 4, 1996.

[51] Int. Cl.[6] ..... A47G 5/00

[52] U.S. Cl. ..... 160/371; 160/3; 160/90; 49/386; 16/49; 16/71

[58] Field of Search ..... 160/1, 3, 8, 9, 160/371, 37, 90; 49/450, 501, 386; 16/49, 61, 67, 63, 71, 78, 80

[56] References Cited

U.S. PATENT DOCUMENTS

| | | | |
|---|---|---|---|
| 228,856 | 6/1880 | Bauman | 16/78 |
| 529,101 | 11/1894 | Bauer | 16/80 |
| 2,958,089 | 11/1960 | Roehm et al. | 16/49 |
| 3,095,599 | 7/1963 | Lasier | 16/49 |
| 3,164,404 | 1/1965 | Arnold | 49/386 |
| 3,408,683 | 11/1968 | Zahn | 16/63 X |
| 3,601,842 | 8/1971 | Morrison et al. | 16/49 |
| 3,630,560 | 12/1971 | Atkins et al. | 16/49 X |
| 3,683,450 | 8/1972 | Morrison et al. | 16/49 |
| 4,048,695 | 9/1977 | Juilfs et al. | 16/80 X |
| 4,130,913 | 12/1978 | Rodseth | 16/49 |
| 4,847,946 | 7/1989 | Nam et al. | 16/71 X |
| 4,858,272 | 8/1989 | Ogawa et al. | 16/80 |
| 5,309,676 | 5/1994 | Appelmann et al. | 49/386 X |
| 5,381,628 | 1/1995 | D'Hooge | 16/49 X |
| 5,417,013 | 5/1995 | Tillmann | 49/386 |
| 5,450,651 | 9/1995 | Coleman et al. | 16/49 X |

FOREIGN PATENT DOCUMENTS

| | | | |
|---|---|---|---|
| 2167121 | 11/1985 | United Kingdom | 16/71 |

*Primary Examiner*—Kenneth J. Dorner
*Assistant Examiner*—Bruce A. Lev
*Attorney, Agent, or Firm*—Jack E. Dominik

[57] ABSTRACT

Disclosed is a top mounted interior door closer utilizing as a drive mechanism a yieldable actuator which is exercised during the opening and retraction which is desirably mounted in an encasement having a closing rod extending from one end. The closing rod is secured to a pair of flanking members along a vertical axis, which members, in turn, are positioned for movement in a track. The closer is sandwiched in place interiorly by having elongate slot at the top of the door means of a cover plate. The elongate slot passes a closing link pin pivotally secured to the shaft or bushing joining the rollers or blocks.

5 Claims, 4 Drawing Sheets

26
5
1
3
4
2

26
21
20
16
37
22
18
5
21
22
17
28
29

20
33
19
16
37
11
18
10
16
5
35
15
34
14
36
38
12
31
32
28
29
17
8
30

26
11
22
15
36
34
14
31
5
29
24
28
37
20
19
10
18
35
32
17
8
7
6

DOOR CLOSER AND METHOD

CROSS-REFERENCE TO RELATED APPLICATION

The present application is a continuation-in-part of application Ser. No. 582,290 filed Jan. 4, 1996, entitled Interior Door closes and Method, which application is still pending.

FIELD OF THE INVENTION

The present invention relates to a top mounted door closer and method for doors particularly where the closer mechanism is to be hidden interiorly of the door in the closed configuration. Such structures are found in United States Classes 160/37; 160/90; 49/450; 49/501; 52/223R; 52/455 and 52/582.

BACKGROUND OF THE INVENTION

Door closers have been used for many years. They run the gambit from weights which travel about a pulley to open and close the gate to a pasture to spring-loaded screen doors in which the closer is coaxial with the hinge pin. Others utilize a complex hydraulic mechanism in combination with folding linkage at the top of the door.

The principal disadvantage of most door closers is that they are exteriorly mounted, and can collect dust and dirt as well as become snagged with other forcing items around the door closer environment. Moreover, with the coaxial spring type on a spring door the aesthetics are far short of the smooth looking exterior that homeowners demand today.

One of the problems that confronted the prior-art door closer was the use of a solid door. The convenience of mounting on the exterior of the solid door inhibited the recognition that a recess could be routed for a door closer just the same as a recess can be routed for a latching mechanism. Accordingly, most efforts were addressed to exterior mounting of the door closer. With the advent of molded doors such as disclosed in U.S. Pat. No. 4,311,183 issued Jan. 29, 1982, the hollow interior portion of a wide variety of doors, whether storm doors, primary doors, or interior doors are hollow and thus lend themselves to the potential of mounting a door closer interiorly. Exemplary of such an attempt, is U.S. Pat. No. 4,311,183 showing an interior mounted door closer with a rack and pinion structure. Such structures are inherently expensive, difficult to maintain and adjust, and do not have the flexibility of transferability from a left-hand unit to a right-hand unit.

Also known are top mounted, relatively hidden closers in which a substantial torsion spring is mounted in the upper portion of the door frame. The spring has an axle that is coupled to a link, which link extends to a sliding block on a track in a groove on the top of the door. Such units are relatively expensive and require a dedicated door frame. In addition, where the door itself is plastic molded, significant reinforcements are required to adapt to the torsion spring mounted in the upper portion of the door.

In utilizing a linear actuator in a door closer of the common variety found in many households, the anchor portion extends outwardly from the side of the door frame, and the closer is secured to the inner face of the door frame. In this manner any torsional loading is minimized because the opening and closing force elements are in substantially the same plane. When it is desired to recess the members in the upper portion of the door, of necessity, the closing effort on the piston rod is in a plane different than the closing element in the link that goes to the door. This automatically induces a torsion load which must be accommodated to avoid the unit binding in operation.

SUMMARY OF THE INVENTION

The present invention is directed to a top mounted interior closer utilizing as a drive mechanism a yieldable actuator which is exercised during the opening and retraction which is desirably mounted in an encasement having a closing rod extending from one end. Various drives including springs, hydraulic, and pneumatic linear actuation are contemplated. The closing rod is secured to a pair of flanking members along a vertical axis, which members, in turn, are positioned for movement in a track. Alternatively rollers or blocks are the track mounted members. The closer is sandwiched in place interiorly by having elongate slot at the top of the door means of a cover plate. The elongate slot passes a closing link pin pivotally secured to the shaft or bushing joining the rollers or blocks. The assembly is completed by securing the end of the link opposite the roller or block to a pivot plate secured to the underneath portion of the upper portion of the door frame. Thus, when assembled the entire closer mechanism is secured interiorly of the door and encapsulated by the sandwich effect between cover plate, the closer, and the track. Additionally, the door is provided with elongate closer mounting recesses at the left and right side of the top so that the closer can be mounted interiorly of the door for a left-hand or right-hand door without having to modify the door itself. Additionally the closer recesses can be formed at the bottom of the door so that with a symmetrical full-view door it can be inverted for left-hand or right-hand mounting. The closer mechanism can be readily reversed and mounted in either configuration. The method of the invention is directed to positioning a closer interiorly of one end of the door, preferably the upper end, which closer is secured to track engaging means in a track which captures the engaging means and thereby dictates linear motion of the closer which is, in turn, translated into a pivotal motion of the closer link which, in turn, is pivotally secured to the upper portion of a door.

In view of the foregoing it is the principal object of the present invention to provide a door top closer for interior mounting in the door which requires primarily a door having a hollow frame and is thus adaptable to a wide variety of doors, and readily adaptable to left-hand and right-hand installation.

Another object of the present invention is to provide an interior door closer which, when closed, shows little evidence to the outside or the inside of the existence of a closer mechanism, and yet which performs with equal efficiency with state of the art closers that are exteriorly mounted.

A further object of the present invention is to provide an interior top mounted closer using a relatively standard state of the art compression spring-pneumatic drive mechanism which is cost effective from a standpoint of tooling, assembly, and application. Alternatively, spring-hydraulic, and other drive mechanisms which can be exercised in an equivalent fashion are contemplated as within the scope of the invention.

Summarizing the objectives of the present invention includes providing a closer which is internal to a storm door or a primary door; providing selected pockets or recesses for the closer mechanism in such a door; masking the closer from view in the closed position thereby upgrading the aesthetics of the door; providing for reversible left-hand and right-hand doors; providing for top or bottom mounting of the closer into the drip cap or the sill or both; including a recessed hold-open device which is self-deactivating; providing for a quick disconnect to open the door greater than 90°; providing for ease of field replaceability of the entire closer assembly; rendering the dampener action of the closer adjustable; providing an internal wind stop which can be made redundant between the stop at the end of the travel of the closer as well as the engagement of the slot on top of the closer plate; and finally providing rollers or sliding blocks for the closer mechanism to engage the closer which will materially enhance the operational life of the closer assembly.

BRIEF DESCRIPTION OF THE ILLUSTRATIVE DRAWINGS

Further objects and advantages will become apparent as the following description of the illustrative drawings take place, in which.

Figures 1, 2, 3:
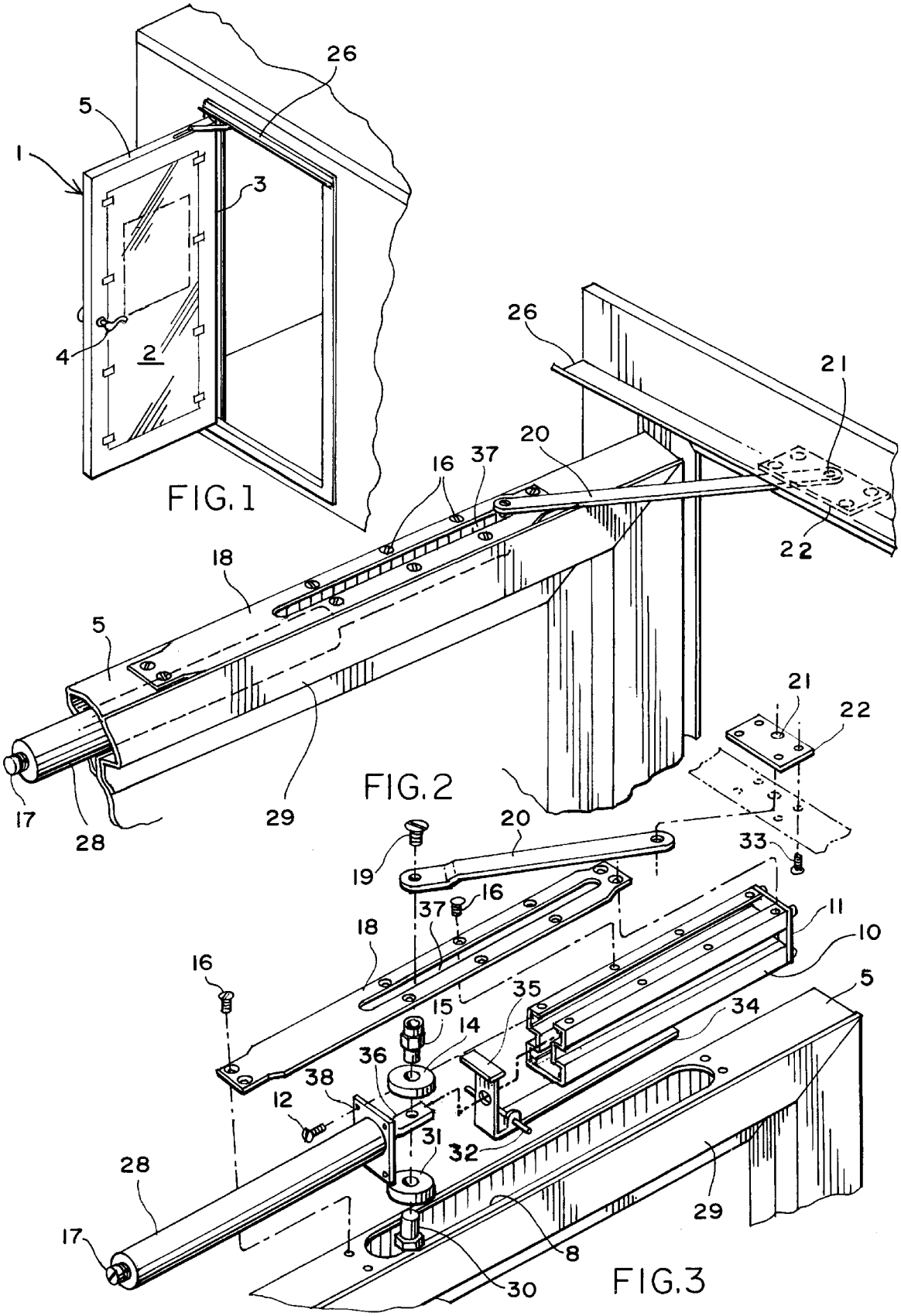
FIG. 1 is a perspective view of a full-view door with a smaller or larger window, the larger size being shown in FIG. 1.
FIG. 2 is an enlarged partially broken view of the closer in FIG. 1 illustrating in dotted lines the interior portion of the door.
FIG. 3 is an enlarged exploded perspective view of the door closer as applied to the specific door.

DESCRIPTION OF A PREFERRED EMBODIMENT:

The invention is illustrated as used in a door opening from the right-hand side and hinged from its left-hand side, such a door 1 being shown in FIG. 1. It will be seen that the door has a window 2 which can be small or full view as illustrated in phantom lines in FIG. 1. The door has a hinge 3, handle 4, door top 5, and drip cap 26 with a slot 8 at the top. The closer 28 is positioned interiorly of the door 1 at one end of slot 8, with a guide track 10 at the opposite portion. An end plate 11 is provided for the guide track 10 which is secured by means of end plate screws 12 to screw mounting slots in the extrusion which forms the guide track 10. Oppositely, the closer 28 is mounted by the use of a closer bracket 38 which secures the closer 28 to the track 10 to form a unitary relationship between the two.

In a first embodiment, a pair of rollers, top roller 14 and bottom roller 31, are secured to the closing rod 36 of the closer 28 by means of male bushing 15 and female bushing 30 which, from a functional standpoint, become the axle for the rotation of the rollers 14 and 31. A closing link 20 is secured to the male bushing 15 and female bushing 30 by means of link bolt 19 which is secured interiorly of the male bushing 15.

Provision is made for a hold open assembly which includes hold open pin 32 secured to the hold open L-shaped link 34 which, in turn, engages the slide bushing 30 mounted to the end of the roller 31 or block 40. The hold-open link 34 is manually moved by the protruding tab 35 to engage the hold open link 34 to secure the door in the open position when so desired. In operation the hold open link 34 may be lifted into locking position when the door is opened normally between 85° and 90° by depressing the tab 35. When the user wants to deactivate the opener, the door is merely pushed slightly further open, the link 34 drops out urged by gravity, and the hold open device is deactivated.

As stated earlier, the door top 5 is provided with a slot 8 at both the top and the bottom with a full view door, but otherwise at opposite portions of the top, which permits the entire closer assembly to be secured on the inside of the door regardless of whether positioned as a left-handed or a right-handed door. The entirety of the assembly is secured in place by the sandwich effect between the cover plate 18, the door top 5, the guide track 10, and the closer 28.

Figure 9:
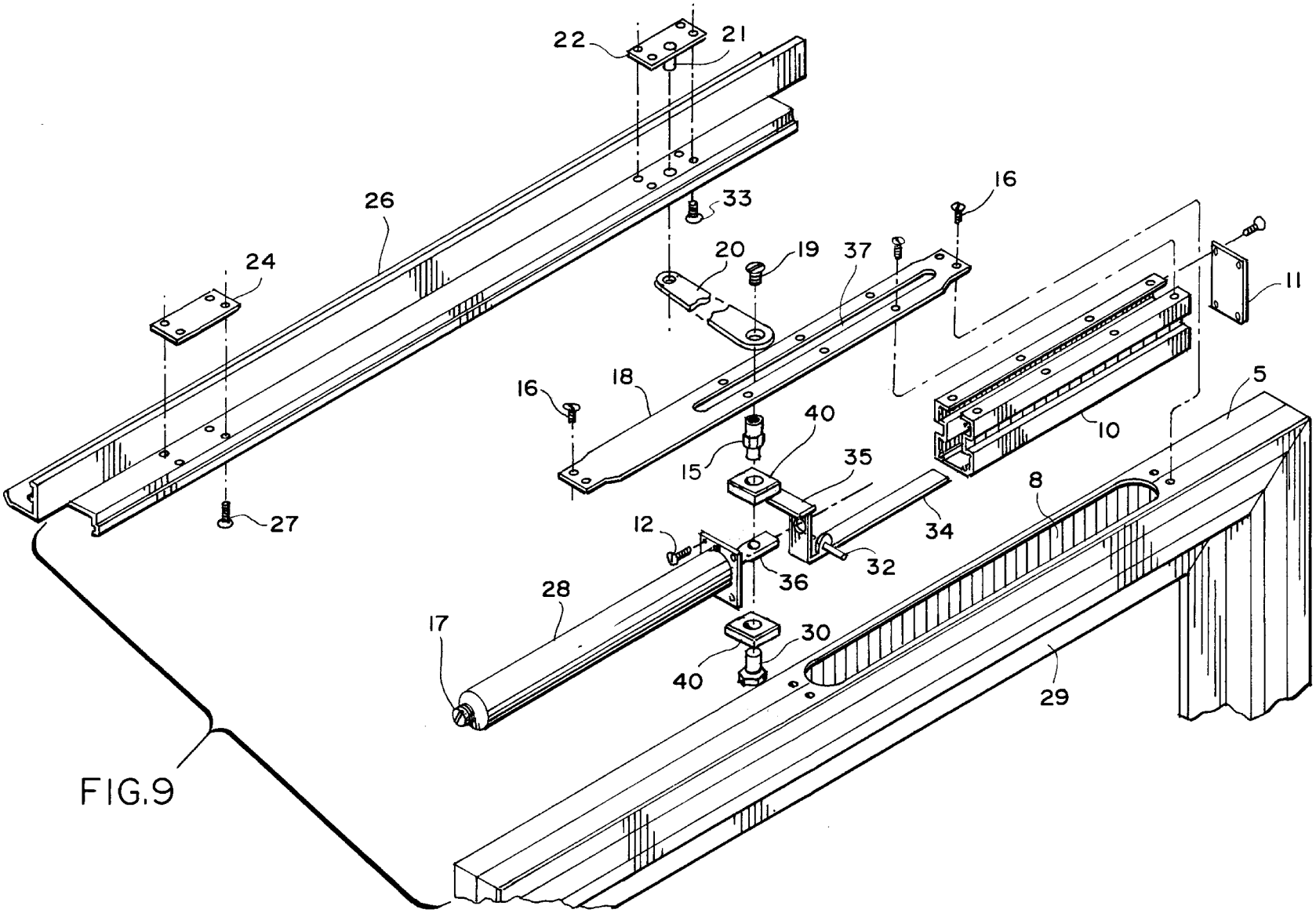
FIG. 9 is an alternative embodiment exploded perspective from the same vantage point as FIG. 3 but illustrating blocks and a shaft joining the two for guide relationship interiorly of the track guide.
Figure 10:
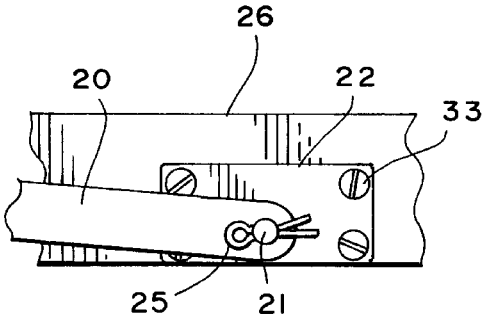
FIG. 10 is an enlarged partially broken view of the quick disconnect shown in the connected position.
Figure 11:
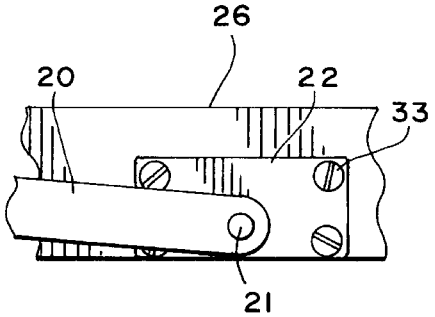
FIG. 11 is a view comparable to FIG. 11 but with the cotter key removed to show for the quick disengagement of the link.
Figure 12:
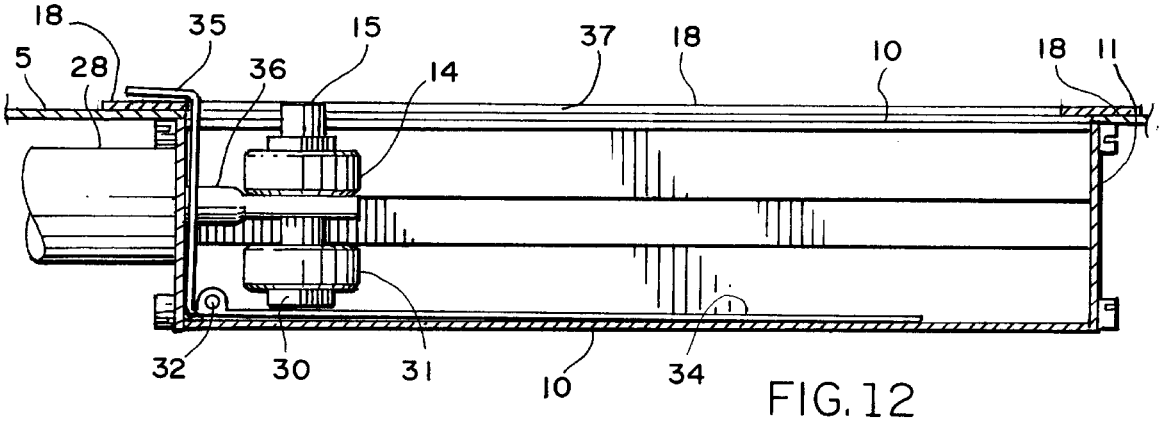
FIG. 12 is a partially diagrammatic longitudinal sectional view of the closer illustrating the hold-open mechanism in the disengaged configuration.

Finally, the link 20 must be secured to the upper portion of the door. To that end, ideally a drip cap 26 is provided for securement to the upper portion of the door. Its configuration is primarily to provide means for drainage and more particularly for the mounting of a drip cap pivot plate 22. The drip cap pivot plate 22 is secured to the drip cap 26 by means of drip cap mounting screws 21. As shown, the link 20 can be positioned on either end of the drip cap inasmuch as drip cap shim 24, and shim screws 27 can be provided at the opposite sides of the door or alternative usage as left-hand or right-hand. Drip caps are not always required for the mounting. Where no drip cap is employed, there still must be a pivot plate 22 or its equivalent, secured to the upper frame portion of the door. Shown consecutively in FIGS. 10 and 9 are the link 10, the pivot plate 22, the pin 23, and the cotter key 25.

Figure 13:
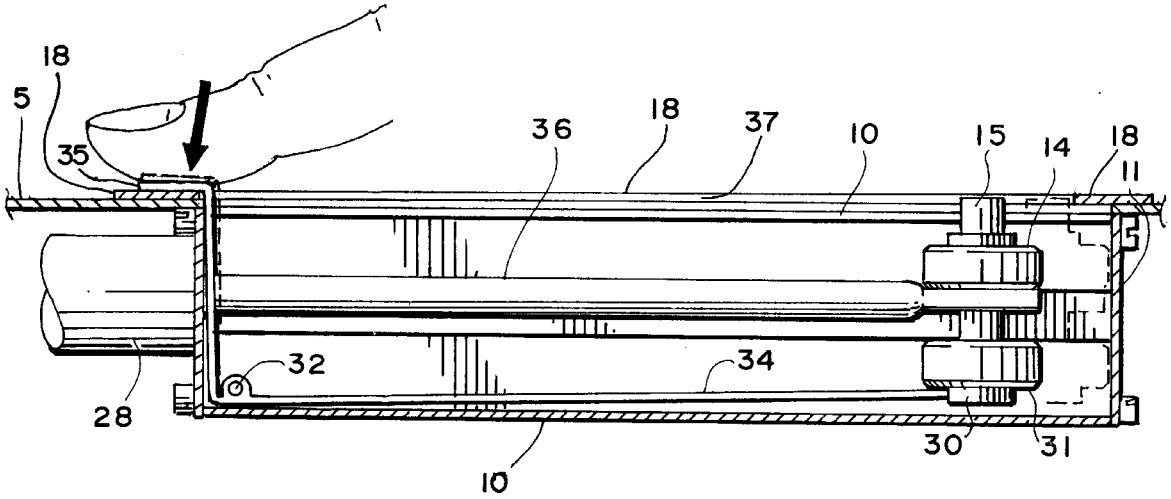
FIG. 13 is a view sequential to that of FIG. 12 illustrating how the hold-open device engages the sliding or rolling member mount to temporarily hold the door open.

An internal wind stop may be achieved in redundant fashion. The end plate 11 when engaged by the rollers 14, 31 or blocks 40 of the closer 28 serves to stop the door in the approximately 90° position as shown in FIG. 2. It is similarly diagrammatically indicated in FIG. 13 where it will be seen that the rollers, in FIG. 13, are on their way to engaging the end plate 11. Similarly, the male bushing 15 engages the remote end of the slot 37 in the cover plate 18 and at that point serves to stop the opening of the door as well.

Figures 4, 5, 6, 7, 8:
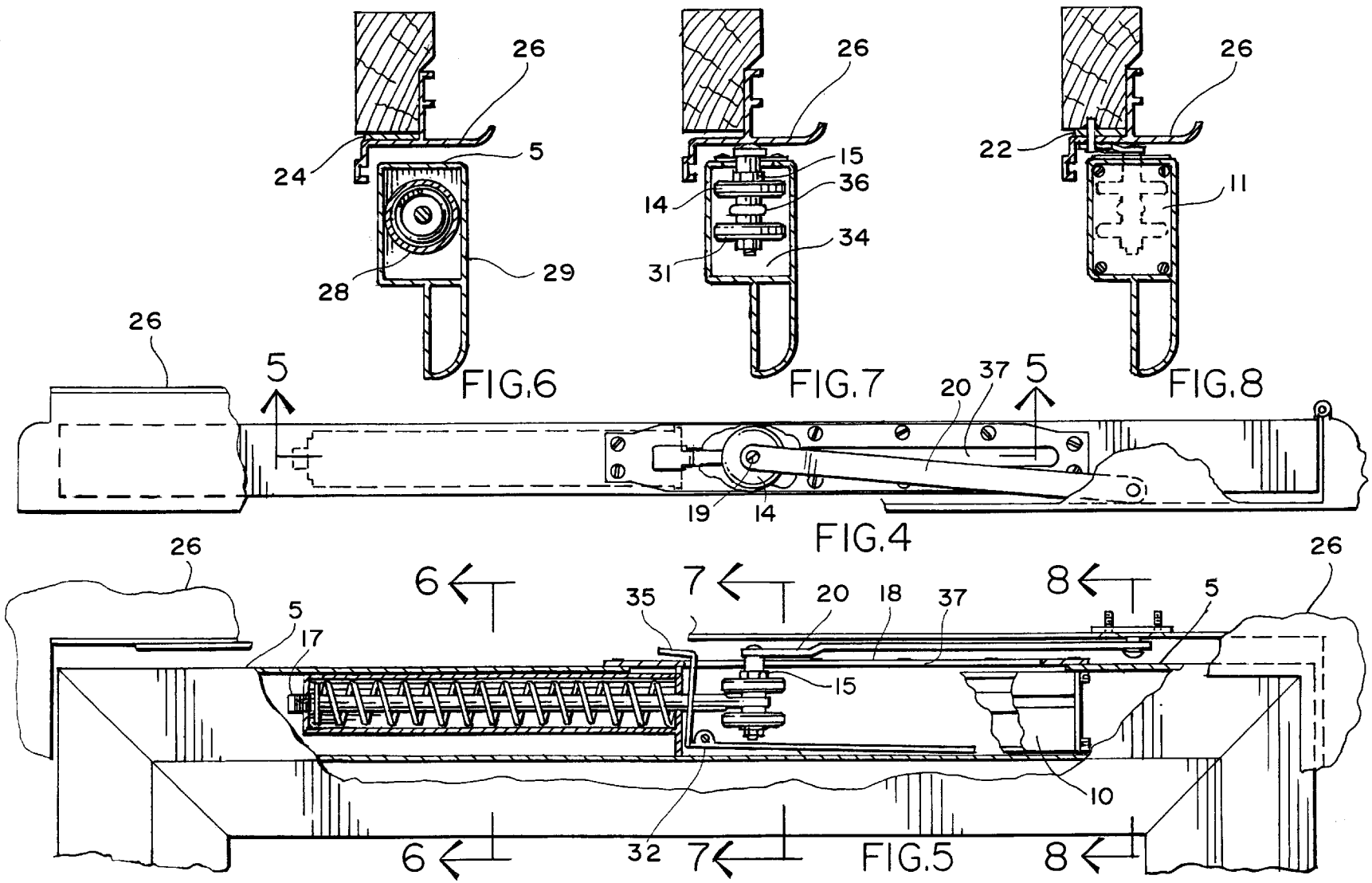
FIG. 4 is a top view of the closer partially broken to show the interior compression member.
FIG. 5 is a front elevation of the subject door, partially broken and partially sectioned to illustrate the spring and the linkage mechanism.
FIGS. 6–8 are transverse sectional views taken along section lines 6, 7, and 8 of FIG. 5 illustrating the drip cap and its correlative relationship to the interior mounted rollers.

While it is contemplated that the bulk of the closers will be mounted at the upper portion of the door as shown in FIG. 1, they can be similarly mounted at the bottom of the door to the sill. Moreover, in areas where extreme wind gusts are contemplated, the closer can be mounted both at the upper portion of the door to the frame and at the bottom to the sill to thereby provide for uniform opening and closing effect. In addition, a dampener mechanism 17 is provided at either the front or rear portion of the closer 28. When it is adjacent the closing rod 36 portion of the closer 28, access may be had through the slot 8 in the cover plate 18. Alternatively, when it is on the far portion of the closer 28 as shown alternatively in FIG. 5, access is provided by drilling a hole or otherwise forming an opening at the upper portion of the door for access to adjust the dampening action.

The method of the invention is directed to providing a door 1 with a door slot 8 for receiving the closer assembly. Important to the method is sandwiching the elements of the door closer together and then mounting the assembly interiorly of the door and adjacent a slot cover plate 18 which secures itself to both the guide track as well as the closer mechanism itself. As a consequence, the securement of the closer interiorly of the door is a function of the sandwich action on the lateral edges of the slot 8. Securement of the link for opening and closing is provided to a mount desirably on a drip cap 6, but otherwise to the upper portion of the door frame.

An alternative embodiment of the closer is shown in FIG. 9. There it will be seen that blocks 40 are utilized with block coupler shaft 41 for insertion in the guide track 10 which track is like that as used for the roller, but with blocks 40 proportioned in cross-section to slidably nest interiorly of the track portion. The shaft 41 is pivotally secured to the link 20 in essentially the same fashion as with the previously described embodiment utilizing rollers. A further alternative embodiment, not shown, utilizes a single block with a single coupler shaft. This permits the utilization of a single formed tubular member for the interior track and eliminates the need for the spacer between the two blocks as shown in FIG. 9. The blocks 40 may be formed of Teflon, nylon, polypropylene, or other relatively slick plastic. In addition, they can be formed of a self-lubricating metal, or other material just so long as they slide interiorly of the track portion.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. A door closer for recessed mounting in a door having sides, a bottom, and an upper portion, said door having a door closer recess at its upper portion comprising, in combination, said door closer having a longitudinal axial yieldable means, a closer rod secured to and operatively connected to the closer, a guide track for receiving guide means, guide means secured to the closer rod such that the closer rod moves longitudinally of the guide track, a closer link for pivotally mounting to the closer outside the upper portion of the door, said closer link being proportioned for pivotal attachment to the door frame, means for securing the closer rod to the closer link, a cover plate with a slot permitting coupling the drive link to the closer rod, said cover plate being shaped to cover the closer recess in the upper portion of the door and to be mounted to the upper portion of the door, the roller track, and the closer, a hold-open mechanism secured to the central portion of the guide track, said hold open mechanism having a hold open link separate hold open tab, and a hold open pin for securing the link and tab for removable disengagement when the door is further opened from the hold open condition.

2. A door closer assembly for mounting, in a door at he upper portion thereof, said upper portion of the door having a recess proportioned to receive the operative portion of the closer assembly, comprising, in combination, said door closes having a closer drive mechanism having yieldable longitudinal compressing and tensioning means, a closer rod coupled to said yieldable means, a guide assembly secured to the end of the closer rod, a guide track for receiving said guide assembly, said guide assembly having a shaft oriented vertically and essentially perpendicularly with the guide track, a closer link for securing to the shaft of the guide assembly and having means for pivotally engaging a door frame, and means for securing said closer in the recessed upper portion of the door to permit the link and closer rod to store potential kinetic energy as the door is opened, and reconvert the potential kinetic energy stored to direct kinetic energy to lose the door when the door is released.

3. In the closer of claim 2, a hold-open mechanism secured to the cent al portion of the guide track, said hold open mechanism having a hold open link, a separate hold open tab, and a hold open pin for securing the link and tab for removable disengagement when the door is opened from the hold open condition.

4. A door closer for recessed mounting in a door, which door has sides, a bottom, and an upper portion, sand door having a closer recess in its upper portion comprising, in combination, a closer having longitudinal axial yieldable means, a closer rod coupled to said longitudinal axis yieldable means, guide means secured to said closer rod for resisting torsional loads applied to said closer rod, track means for securing said guide means to move longitudinally in a confined linear track, a closer link pivotally secured to the upper portion of said guide means, means for securing said closer link to the upper portion of the door frame in which the subject door and closer are hingedly secured, an end plate for said track, and wind stop means formed by proportioning and shaping the closer rod to engage the end plate of the track in a predetermined maximum open position.

5. A door closer for recessed mounting in a door, which door has sides, a bottom, and an upper portion, said door having a closer recess in its upper portion comprising, in combination, a closer having longitudinal axial yieldable means, a closer rod coupled to said longitudinal axial yieldable means, guide means secured to said closer rod for resisting torsional loads applied to said closer rod, track means for securing said guide means to move longitudinally in a confined linear track, a closer link pivotally secured to the upper portion of said guide means, and means for securing said closer link to the upper portion of the door frame in which the subject door and closer are hingedly secured, forming and proportioning the means for securing the members which slide in the guide track and their connection to the closer link to the end that said guide means engage the remote end of the slot in the cover plate at a predetermined maxiimum location of opening, wind stop means formed by proportioning and shaping the closer rod to engage the end plate of the track in a predetermined maximum open position, and forming and proportioning the means for securing the members which slide in the guide track and their connection to the closer link to the end that said guide means engage the remote end of the slot in the cover plate at a predetermined maximum location of opening, whereby a redundant wind stop effect is provided in the closer.

* * * * *